US005712611A

United States Patent [19]

Mattes et al.

[11] Patent Number: 5,712,611

[45] Date of Patent: Jan. 27, 1998

[54] ELECTRICAL SWITCH HAVING A STATIONARY CONTACT OF A BIMETALLIC MATERIAL

[75] Inventors: Anton Mattes, Balgheim; Roland Neitzel, Muehlheim, both of Germany

[73] Assignee: Marquardt GmbH, Rietheim-Weilheim, Germany

[21] Appl. No.: 423,350

[22] Filed: Apr. 18, 1995

[30] Foreign Application Priority Data

Apr. 19, 1994 [DE] Germany ..... 44 13 376.6

[51] Int. Cl.[6] ..... H01H 37/52; H01H 1/04

[52] U.S. Cl. ..... 337/334; 337/333; 337/380; 200/263; 200/283

[58] Field of Search ..... 200/263, 266, 200/280, 281, 283, 239; 337/9, 3, 333, 334, 363, 373, 379, 380

[56] References Cited

U.S. PATENT DOCUMENTS

| | | | |
|---|---|---|---|
| 2,234,346 | 3/1941 | Ives | 200/166 |
| 2,730,594 | 1/1956 | Page | 200/166 |
| 3,493,707 | 2/1970 | Castle . | |
| 3,586,808 | 6/1971 | Shibata | 200/166 |
| 3,916,512 | 11/1975 | Sato et al. . | |

FOREIGN PATENT DOCUMENTS

| | | |
|---|---|---|
| 2568054 | 1/1986 | France . |
| 1120544 | 12/1961 | Germany . |
| 7004948 | 2/1970 | Germany . |
| 2226979 | 1/1973 | Germany . |
| 2159411 | 6/1973 | Germany . |
| 2348205 | 4/1974 | Germany . |
| 3542953 | 4/1986 | Germany . |

OTHER PUBLICATIONS

Maronna et al:"Schweissverfahren zum Kontaktieren elektrischer Anschlüsse in der Mikroelektronik". In: Schweisstechnik, 20, 1970, vol. 9, pp. 386–390.

Taubitz G.: "Verarbeitung von Kontaktmaterialien". In: elektro–anzeiger, 35. Jg., 1982, No. 21, pp. 28–31.

Firmendruckschrift: Mikro–Kontaktprofile, No. PK–B14, D/E/F/2C, 11.81UN, Ko. der Fa. W.C.Heraeus GmbH, Hanau.

*Primary Examiner*—Leo P. Picard
*Assistant Examiner*—Jayprakash N. Ganohi
*Attorney, Agent, or Firm*—Spencer & Frank

[57] ABSTRACT

The invention relates to an electrical switch having a contact system which includes a switching contact and at least one stationary contact. The stationary contact has a body and a contact surface which interacts with the switching contact. Furthermore, the stationary contact is arranged on a contact support which has a first wide side and a second narrow side approximately at right angles thereto and in which a recess is located in the first side, which recess has an opening, which faces the switching contact, on the second side. The body of the stationary contact is inserted into the recess in such a manner that the contact surface of the stationary contact is located on the second side. The stationary contact is designed as a bimetallic contact made of a first material for the body and of a second material in the form of a contact facing on the body. The bimetallic contact is arranged as a prefabricated part, with the contact facing as the contact surface on the contact support. A method for producing such a switch is furthermore described.

17 Claims, 10 Drawing Sheets

ELECTRICAL SWITCH HAVING A STATIONARY CONTACT OF A BIMETALLIC MATERIAL

The invention relates to an electrical switch having a contact system. The contact system includes a movable switching contact having a contact face, and that is electrically connectable to a power source. The contact system further includes at least one contact support having a portion defined by a broad side approximately perpendicular to the contact face of the switching contact, and a narrow end face facing the contact face of the switching contact. The contact support has a recess formed in the broad side extending from a recess opening located in the end face. A stationary contact has a body inserted into the recess, and a contact surface located on the end face. The invention further relates to a method for producing a contact for such a switch including the steps of providing a profiled wire composed of a contact material, cutting the profiled wire to form a contact component having a predetermined length, and fitting the contact component to the contact support.

There is a tendency to miniaturization of such switches. This leads to the size of the housing of the switch being reduced, the contact system having to be designed such that it can be installed in the installation space in the housing.

An electrical switch having a contact system which is arranged in a housing has been disclosed in U.S. Pat. No. 3,493,707. The contact system comprises a switching contact and two stationary contacts. The body of the respective stationary contact is fastened to a contact support, on the first side, which contact support has a first wide side and a second narrow side which is approximately at right angles thereto. In turn, the contact support is in electrical contact with an electrical connection which projects out of the housing. An operating device which extends into the housing of the switch acts on the contact system in such a manner that the switching contact interacts in a switching manner with the contact surface of in each case one stationary contact.

It is disadvantageous in the case of the known switch that an elongated construction results for the contact system as a result of the arrangement of the stationary contacts. Such a contact system is thus less suitable for small installation spaces in the housing of the switch. In consequence, further miniaturization of this switch is not feasible. In addition, this switch is composed of a large number of individual parts, as a result of which assembly is complex and cost-intensive. Furthermore, assembly can be automated only to a limited extent.

Furthermore, DE-AS 23 48 205 discloses an electrical switch which is provided with a contact system of smaller design. On the first, wide side, the contact support of this contact system has a recess which, in turn, is provided with an opening, facing the switching contact, on the second narrow side. The body of the stationary contact is inserted into this recess in such a manner that the contact surface of the stationary contact is located on the second narrow side. As is furthermore evident from this Laid-Open Specification, the contact support is produced in the form of a stamped grid, starting from a sheet-metal strip. An approximately I-shaped recess, into which silver is introduced as the contact material, is stamped in that part of the sheet-metal strip which is assigned to the contact support. The contact material is subsequently stamped out such that the contact surfaces produce two stationary contacts for the contact system. As can be seen immediately, the contact surface comprises a stamped edge and thus requires costly reprocessing. In addition, expensive contact material is used for the entire stationary contact, from which a considerable amount of scrap results during the production of the switch. It is likewise disadvantageous that, because of the necessary further processing steps, there is no possibility of using prefabricated contact profiles which are already provided with a ready-made contact facing.

A method for producing a stationary contact, which is located on a contact support, using a wire made of contact material is furthermore known, for a conventional switch, from DE-A 22 26 979. In the case of this method, contact pieces are cut to length from a wire which is pushed forwards section by section and is made of contact material. These contact pieces are then introduced into a through-hole on the contact support and are subsequently riveted to the contact support. It has been found to be disadvantageous in the case of this production method for the stationary contacts that the fastening of the stationary contacts to the contact supports is difficult and very costly. This results in individual parts which are expensive and are also associated with a large element of scrap. In addition, the contact surface must also be subsequently processed here, so that the use of a wire already provided with a contact facing is not possible.

SUMMARY OF THE INVENTION

The invention is based on the object of further developing the contact system on an electrical switch having a confined installation space in such a manner that it can be produced without any significant reworking and with large-scale automation of assembly being possible, and of indicating a production method which is suitable for this purpose.

In the case of an electrical switch of this generic type, this object is achieved by providing a prefabricated stationary contact arranged on the contact support, and comprised of a bimetallic material. The stationary contact has a body composed of a first material, and is insertable into the recess. The stationary contact further has a contact surface forming a facing of the body, and is composed of a second material. The contact surface projects through the recess opening on the end face and interacts with the switching contact to form an electrical connection. In the case of a method of this generic type for producing a contact for such an electrical switch, this object is achieved by providing a prefabricated, bimetallic wire composed of the first material for the body of the stationary contact, and the second material for the contact surface of the stationary contact. The contact component is inserted into the recess of the contact support from a direction perpendicular to the broad side, wherein the contact facing is exposed, projects beyond a plane defined by the end face, and forms, without any further processing, the contact surface of the stationary contact.

Copper, a copper-nickel alloy or the like is, in particular, suitable as the material for the body of the bimetallic contact. The contact facing may be composed of silver, a silver-nickel alloy, a palladium-copper alloy or the like. Finally, gold, a gold-silver alloy or the like is suitable for the contact coating.

In order to simplify production, it is possible for the stationary contacts to be composed of a section of a prefabricated, possibly profiled wire, the wire having a contact facing on the front surface. The contact facing can possibly also be provided with a further contact coating, which is likewise prefabricated. These contact pieces formed by the sections are inserted into the recess on the contact support, on the side of the contact support which is approximately at right angles to the switching contact, such that the contact facing is exposed on the side of the contact support facing the switching contact. No further processing of the contact surface is then carried out.

Good fastening of the stationary contact on the contact support is achieved in that the body of the stationary contact is designed with a cross section corresponding to the recess. That contact surface of the stationary contact which interacts with the switching contact can be level with that side of the contact support which faces the switching contact, or else can project beyond this side in the direction of the switching contact. It is furthermore possible to fasten the body of the stationary contact in the recess on the contact support by means of stamping, peening and/or welding. Spot welding by means of laser welding, electron-beam welding, resistance welding or the like has been found to be particularly suitable for this purpose, laser welding being preferred because of the precise positioning of the spot welds.

A shape for the recess which can be produced particularly easily is for this recess to be designed with one or two side limbs and one base limb. The base limb and the side limbs are then arranged approximately in an "L-shaped or U-shaped" manner.

Further simplification of assembly is achieved in that the contact support is designed in the form of a conductor track and is produced as a stamped grid. The stamped grid can be extrusion coated with the housing of the switch after the stationary contact has been introduced, the connections on the stamped grid which are not required being cut through. The electrical connections which project from the housing and are in electrical contact with the contact support can be designed with a holder, like an attachment piece. Connecting tabs for the electrical switch can be fitted into the holder in a positively locking and/or force-fitting manner. This results in an advantageous manner in the option for the electrical switch to be adapted in a simple manner in accordance with the geometry of the electrical connection to further electrical components. For example the connecting tabs can be designed as plug connections for arrangement of the switch on a printed circuit board.

More far-reaching reduction in the size of the contact system can be achieved by the following design of the contact system. The contact tongue which holds the switching contact is mounted on a web, which is located in the housing, in a first holder. Furthermore, a two-armed inner lever is mounted on the web in a second holder, one lever arm of the inner lever being operatively connected to an operating device which extends into the housing, and one end of a tension spring being fastened to the other lever arm, the other end of which tension spring is in turn attached to the contact tongue. The second holder on the web is located closer to the operating device than the first holder. In addition, this design also results in the option of possibly providing the operating device with an extended overtravel.

In the case of a contact system which has been further miniaturized in such a way, it is additionally possible to arrange this contact system in a housing which is provided with a base. Two guide webs, which engage around the inner lever approximately in a U-shape and in turn in each case engage in a housing guide located on the side wall of the housing, are arranged on that side of the operating device which faces the inner lever. The edge of the base can have a circumferential attachment which engages in a correspondingly formed, circumferential recess in a part of the housing.

The advantages which are achieved by the invention are, in particular, production of the stationary contacts more easily and with less scrap. The stationary contacts are prefabricated as a bimetallic contact, separately and independently of the production of the switch, it being possible to use, in particular, a profiled wire as a half-finished item for this purpose. The otherwise normal subsequent coating of the stationary contacts is thus avoided. Reprocessing of the contact surfaces is no longer necessary which leads, on the one hand, to a cost saving and, on the other hand, to quality improvement.

The contact system can advantageously be significantly reduced in size and thus accommodated even in small installation spaces of housings for the switch. In consequence, the size of the switch can be reduced overall. In addition, the accuracy of positioning of the stationary contacts is improved. Furthermore, the number of individual parts is reduced. The production of the switch can be largely automated with the aid of the production method according to the invention. This results in a considerable cost advantage over conventional switches.

BRIEF DESCRIPTION OF THE DRAWINGS

Exemplary embodiments of the invention are described in more detail in the following text and illustrated in the drawings, in which.

DETAILED DESCRIPTION OF THE INVENTION

Figure 1:
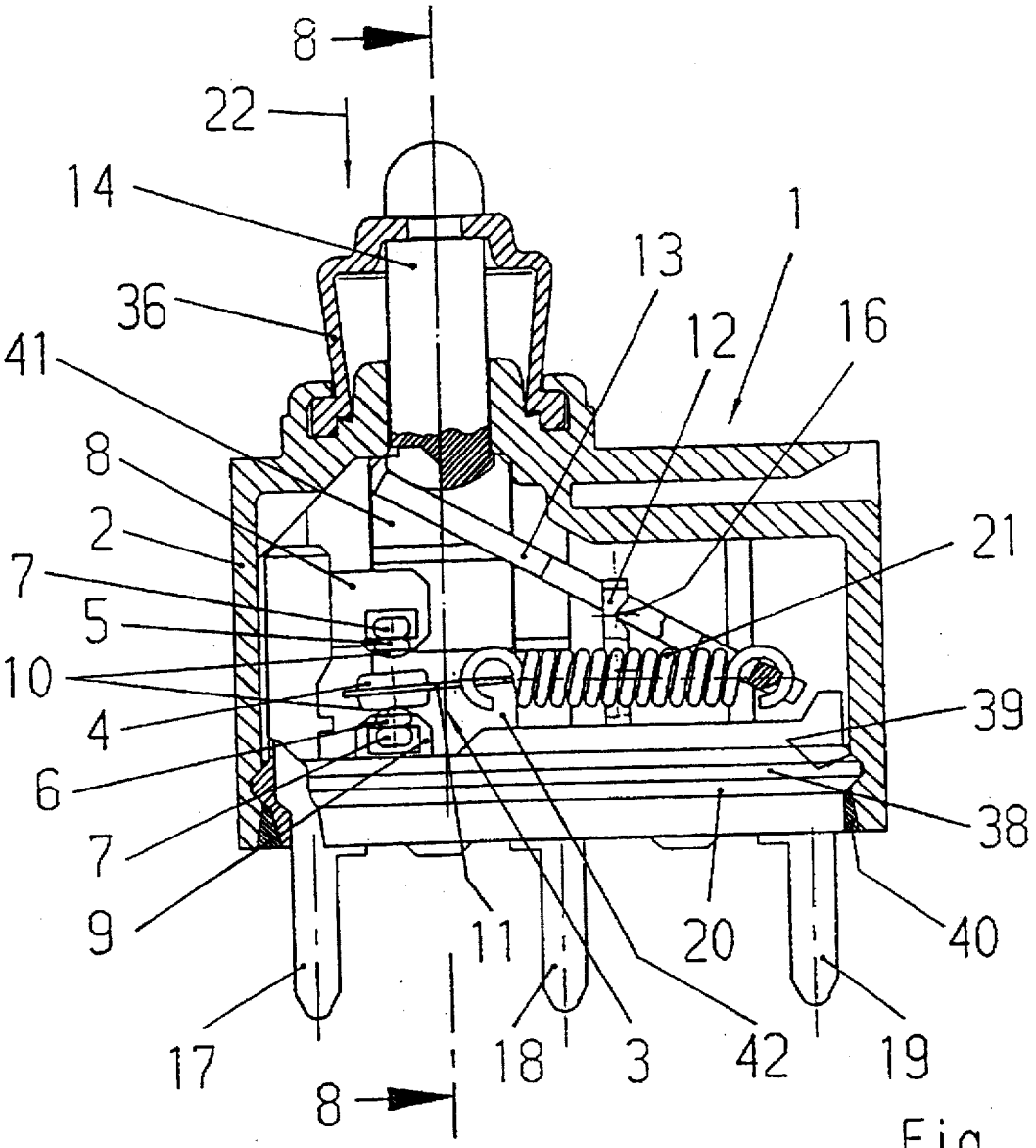
FIG. 1 shows a longitudinal section through an electrical switch.

An electrical switch 1, which is designed as a snap-action switch, can be seen in more detail in FIG. 1. The switch 1 has a housing 2 with a contact system 3 arranged in it. The contact system 3 is predominantly composed of two stationary contacts 5, 6 and one switching contact 4. The stationary contacts 5, 6 are fastened by means of their body 7 to in each case one contact support 8, 9 in such a manner that the actual contact surfaces 10 of the stationary contacts 5, 6 are opposite one another. The switching contact 4 is arranged on a contact tongue 11 which in turn is mounted movably in a first holder 15 on a web (plate) 12 which can be seen in FIG. 2, the switching contact 4 being located between the two stationary contacts 5, 6 and switching over between the two stationary contacts 5, 6. The contact supports 8, 9 and the web 12 are fastened to a base 20 of the housing 2. Three electrical connections 17, 18, 19, which project out of the housing 2, are furthermore located on the base 20 in order to supply the electrical power, the connection 17 being electrically connected to the contact support 8, the connection 18 to the contact support 9, and the connection 19 to the web 12.

The edge of the base 20 is provided with a circumferential attachment (ridge) 38, running slightly conically. A circumferential recess 39, which is formed such that it corresponds thereto, is located in the upper part of the housing 2. During assembly, the upper part of the housing 2 is just snapped onto the base 20. A housing which is protected against the ingress of water and dust is thus obtained in an advantageous manner without further, costly sealing measures being necessary. If necessary, the separating point 40 between the base 20 and the upper part of the housing 2 can also be potted, using a plastic material, in order further to improve the sealing.

The web 12 has a further, second holder 16 on which a two-armed inner lever 13 is mounted such that it can rotate. One lever arm of the inner lever 13 is operatively connected to an operating device 14, which extends into the interior of the housing 2, at the top. On top of the housing 2, the operating device 14 is provided with bellows 36 for sealing. One end of a tension spring 21 is fastened to the other lever arm of the inner lever 13. The other end of the tension spring 21 is attached in the contact tongue 11. The second holder 16 for the inner lever 13 is located closer to the operating device 14 than the first holder 15 for the contact tongue 11, so that the contact tongue 11 runs essentially underneath the inner lever 13. The contact system 3 can thus be designed to be particularly compact.

Figure 8:
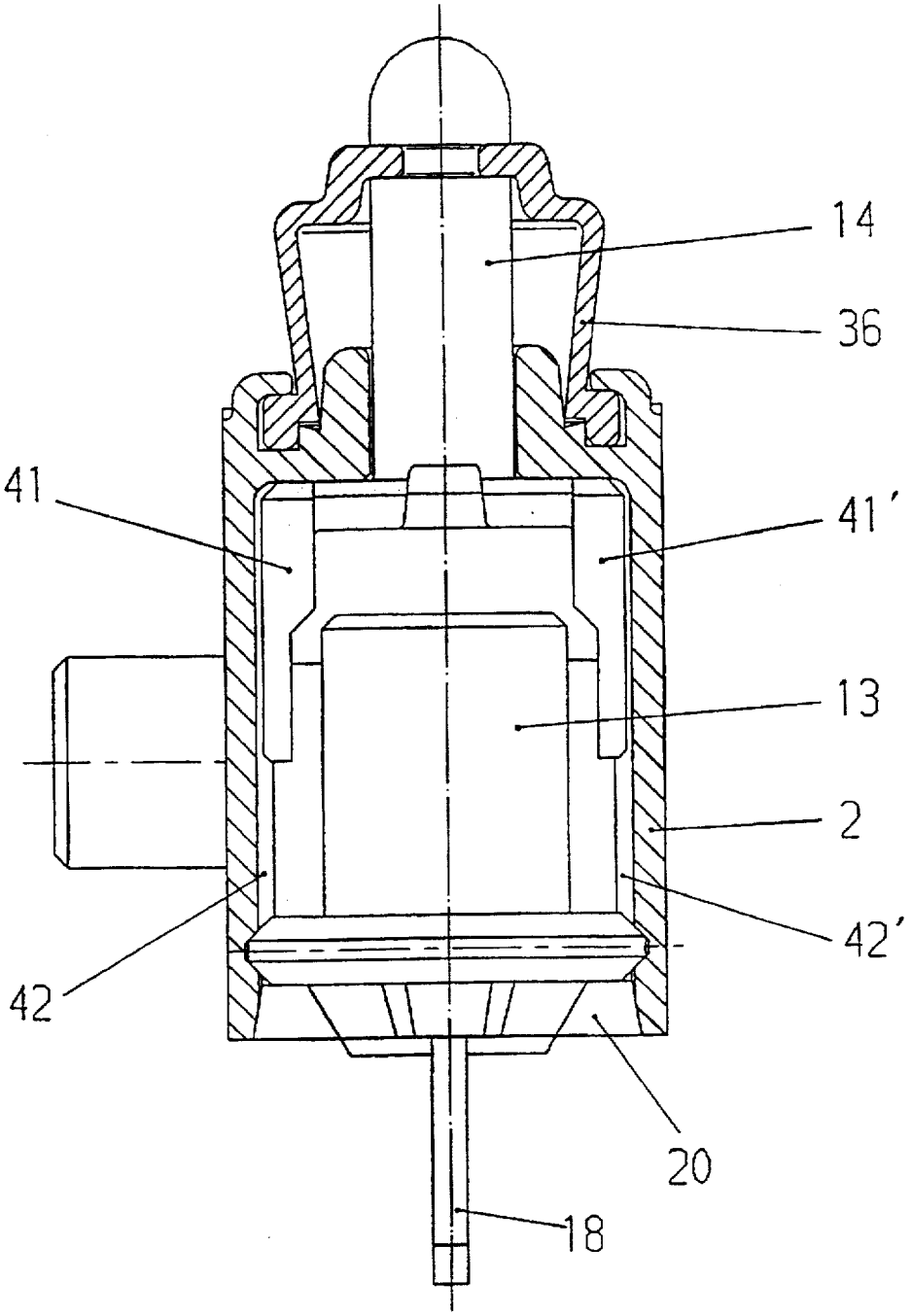
FIG. 8 shows a section along the line 8—8 in FIG. 1, the contact system being omitted for the sake of clarity.

The operating device 14 has two integrally formed guide webs (guide ribs) 41, 41' on its side facing the inner lever 13, which guide webs 41, 41' engage around the inner lever 13 approximately in a U-shape, as can be seen in FIG. 8. Each guide web 41, 41' in turn engages in a housing guide 42, 42', which is designed as a depression, on the side wall of the housing 2. During movement of the operating device 14, the guide web 41, 41' slides in the housing guide 42, 42' so that the operating device 14 is guided in a straight line without tilting. It can, of course, be sufficient to arrange only one guide web 41 and one housing guide 42 for guidance of the operating device 14.

The operating device 14 acts on the contact system 3 in such a manner that the switching contact 4 interacts in a switching manner with a contact surface 10 of the stationary contact 5, 6. If the operating device 14 is in the undepressed position shown in FIG. 1, then the switching contact 4 is resting against the contact surface 10 of the stationary contact 6, as a result of which the connections 18 and 19 are electrically conductively connected. If the operating device 14 is pressed in the direction of the arrow 22, then the inner lever 13 is moved counterclockwise about the rotation point in the second holder 16 and at the same time acts on the tension spring 21. In consequence, the contact tongue 11 snaps around to a specific position of the operating device 14, such that the switching contact 4 rests against the contact surface 10 of the stationary contact 5, as a result of which the connections 17 and 19 are electrically conductively connected.

Figure 2:
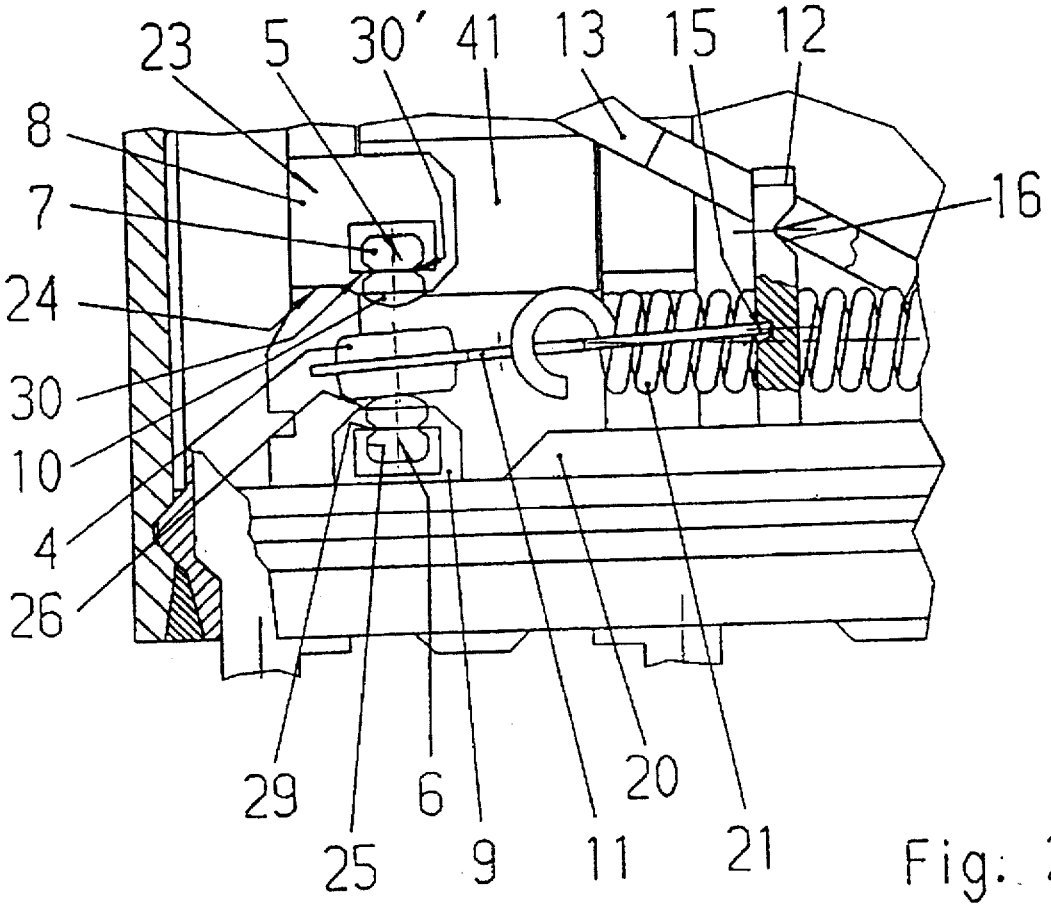
FIG. 2 shows an enlarged detail of the contact system from FIG. 1.

As can be seen in particular from FIG. 2, the contact supports 8, 9 are designed like a conductor track having a first wide (broad) side (face) 23 and a second narrow side (end face) 24 approximately at right angles thereto. In this case, the second narrow side 24 of the contact support 8, 9 faces the switching contact 4. A recess 25 is arranged on the first wide side 23 and has an opening 26 which faces the switching contact 4 and is located on the second narrow side 24. The body 7 of the stationary contact 5, 6 is designed such that its cross section largely corresponds to the recess 25 and is at the same time inserted into the recess 25 in such a way that that contact surface 10 of the stationary contact 5, 6 which interacts with the switching contact 4 is located on the second narrow side 24 of the contact support 8, 9. That contact surface 10 of the stationary contact 5, 6 which interacts with the switching contact 4 preferably projects beyond the second narrow side 24 of the contact support 8, 9 in the direction of the switching contact 4. However, it can also be sufficient for the contact surface 10 to be level with the second narrow side 24 of the contact support 8, 9.

The cross-sectional shape of the recess 25 on the first wide side 23 of he contact support 8, 9 can differ. For example, the recess 25 may be designed to be trapezoidal, triangular etc. Particularly preferred designs for the contact support are shown in FIGS. 3 and 4 using the example of the contact support 8, it being self-evident that the contact support 9 can also be designed analogously thereto.

Figure 3:
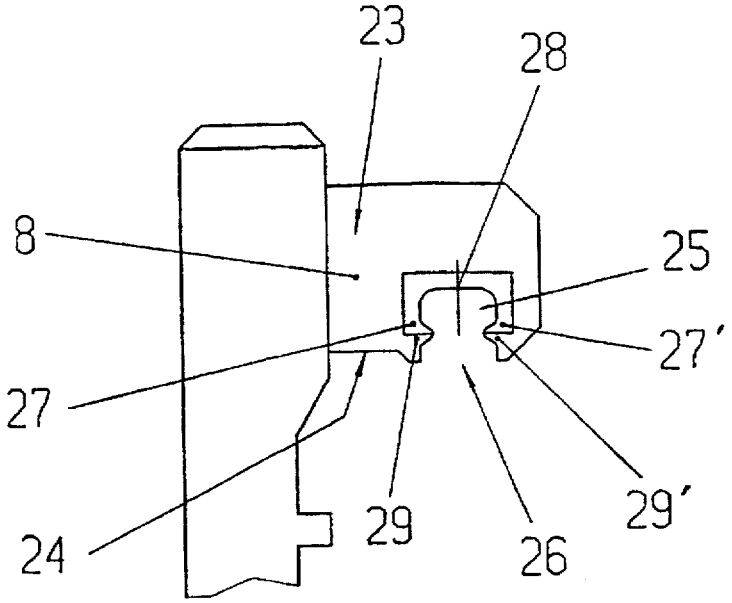
FIG. 3 shows the contact support corresponding to a detail from FIG. 1 in a first embodiment.

The recess 25, which is open on the side facing the switching contact 4, of the contact support 8 according to FIG. 3 thus has two side limbs 27, 27' running approximately at right angles to the contact tongue 11, and a base limb 28, which is arranged on the side facing away from the switching contact 4 and runs approximately parallel to the contact tongue 11 in the switched-over position. The side limbs 27, 27' and the base limb 28 are arranged approximately in a "U-shape" as a boundary of the recess 25 and are preferably introduced in the first side 23 somewhat depressed. The body 7 of the stationary contact 5 is in turn inserted into the recess 25, making electrical contact with the side limb 27, 27' and/or the base limb 28, in such a manner that the contact surface 10 of the stationary contact 5 is at least level with the side limbs 27, 27', preferably projecting beyond the side limbs 27, 27' in the direction of the switching contact 4, as has already been described in conjunction with FIG. 2.

The fastening of the body 7 in the recess 25 can be improved if an attachment 29, 29' projects on at least one side limb 27, 27', which attachment 29, 29' can run approximately at right angles to the side limb 27, 27' and approximately parallel to the base limb 28. This attachment 29, 29' in turn engages in an indentation 30, 30', which can be seen in FIG. 2, on the body 7 of the stationary contact 5. A further improvement in the fastening of the stationary contact 5 in the recess 25 is achieved in that the body 7 of the stationary contact 5 is stamped or peened with the contact support 8. To this end, a stamping or peening tool acts on the body 7 in the direction of the first side 23, so that material of the body 7 at least partially overlaps the side limbs 27, 27' and possibly the base limb 28. If the side limbs 27, 27' and the base limb 28 are incorporated in the contact support 8 such that they are depressed with respect to the first side 23, then the displaced material of the body 7 is accommodated by these depressions and a surface which is essentially level with the first side 23 can be achieved in this area. However, it is essential that there is no influence on the contact surface 10, in particular in the direction of the second side 24, so that damage to the contact surface 10 is precluded. Alternatively or else additionally, a weld, in particular a spot weld, can also be produced between the body 7 and the contact support 8. In experiments, it has been found to be particularly suitable to use laser welding for this purpose. However, other welding methods can also be used in principle, for example electron-beam welding, resistance welding or the like.

Figure 4:
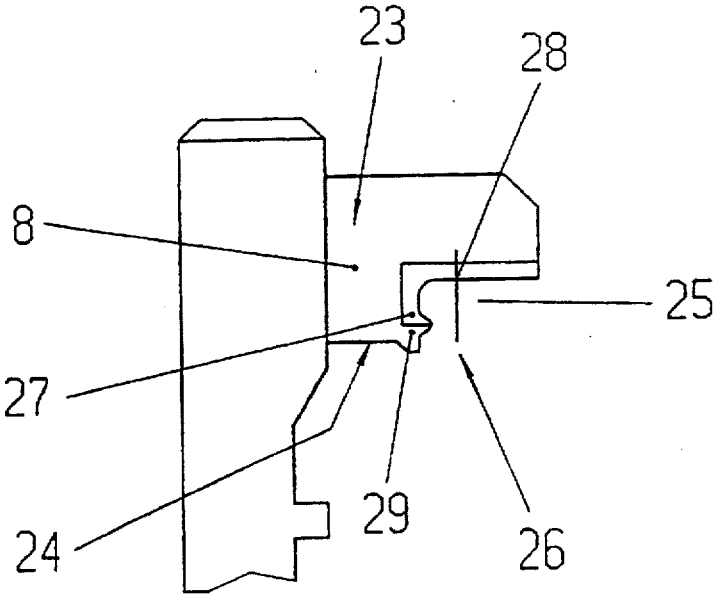
FIG. 4 shows the contact support analogous to FIG. 3 in a second embodiment.

Only a single side limb 27 is arranged in the further design of the recess 25 according to FIG. 4, the side limb 27 being connected to the base limb 28 approximately in an "L-shape". In this case, material can advantageously be saved on the contact support 8. However, for secure fastening of the body 7 in the recess 25, the body 7 should be welded to the side limb 27 and/or to the base limb 28. In the extreme case, the recess 25 can then even be open so far that it is still bounded only on one side, for example by the side limb 27. If this is done, the base limb 28 is then completely omitted in such a design.

Figure 7:
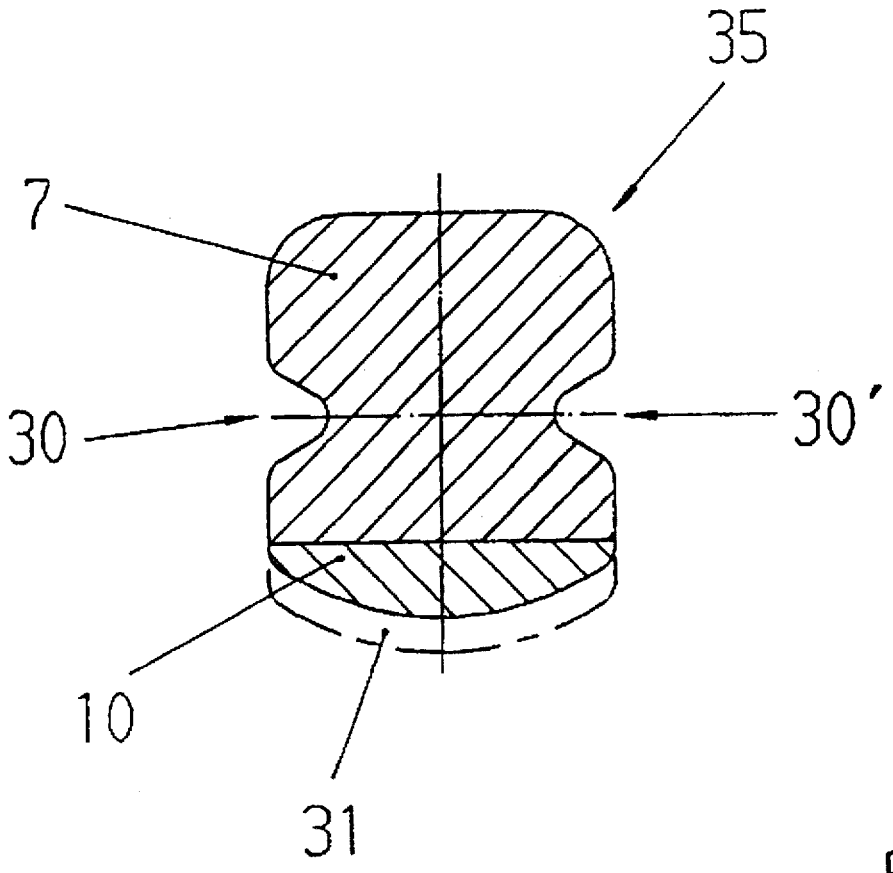
FIG. 7 shows a cross section through the profile of a wire made of contact material.

The stationary contact 5, 6 is designed according to the invention as a bimetallic contact, as can be seen particularly well in FIG. 7. The body 7 of the stationary contact 5, 6 is composed of a first material. The contact surface 10 is designed on the body 7 in the form of a contact facing made of a different second material. The contact surface 10 can possibly also be provided with a further contact coating 31. The bimetallic contact is a prefabricated part. The use of a profiled wire 35 made of contact material having the described construction in the form of a bimetallic wire is particularly expedient, the contact facing, which is possibly provided with the further contact coating 31, being arranged on the front surface of the wire 35 which is opposite the switching contact 4 in the arrangement in the contact system 3. The wire 35 is profiled such that it largely corresponds to the recess 25 in the contact support 8, 9, as a result of which the body 7 possibly already has the indentations 30, 30'. The stationary contacts 5, 6 are cut to the required length from this separately produced wire 35, and these sections are then arranged on the contact support 8, 9 such that the contact facing is used as the contact surface 10.

Depending on the application of the electrical switch 1, various materials can be used for the bimetallic contact in the contact system 3. The contact supports 8, 9 are generally composed of copper or a copper alloy. A copper-nickel alloy has been found to be suitable for the body 7 of the stationary contact 5, 6, particularly when the body 7 of the stationary contact 5, 6 is laser-welded in the recess 25. Silver, a silver-nickel alloy or a palladium-copper alloy is suitable as the contact facing for the contact surface 10. The contact coating 31 may be composed of gold or a gold-silver alloy. Other suitable materials can, of course, also be used for the bimetallic contact.

Figure 5:
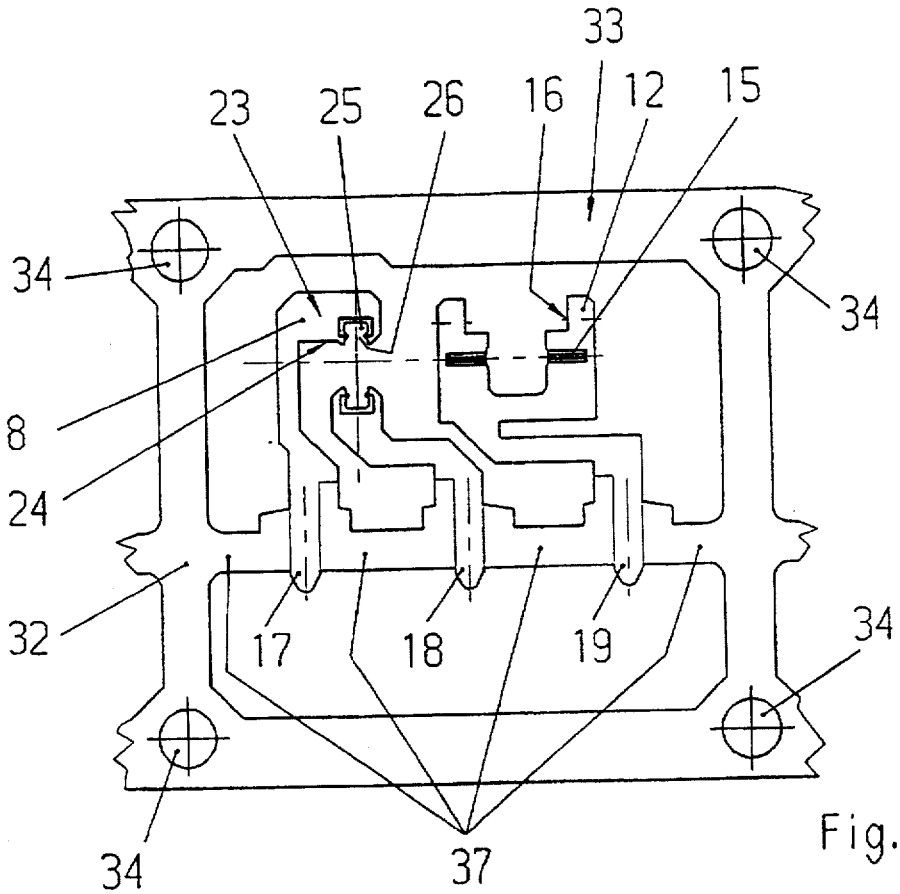
FIG. 5 shows the contact supports in the form of a stamped grid.

The switch according to the invention is particularly suitable for automated production. To this end, it is possible to design the contact supports 8, 9 and the web 12 in the form of conductor tracks as a cohesive stamped grid 32, as is shown in FIG. 5. The stamped grid 32 is stamped out, including the recesses 25, in the contact supports 8, 9 from a strip 33, for example a copper strip, possibly in a plurality of process steps. In this case, the recesses 25 on the contact support 8, 9 are produced on the wide first side 23, which recesses 25 are provided with an opening 26 on the narrow second side 24, in the same stamping process or in a further stamping process. The depressions for the side limbs 27, 27' and the base limb 28 can be stamped, if required, into the strip 33 at a suitable point in one of the process steps. The stamped grids 32 are produced in such a manner that they remain arranged successively in the strip 33. The strip 33 is also provided with reference holes 34, during the stamping process, for further processing and transportation.

Figure 6:
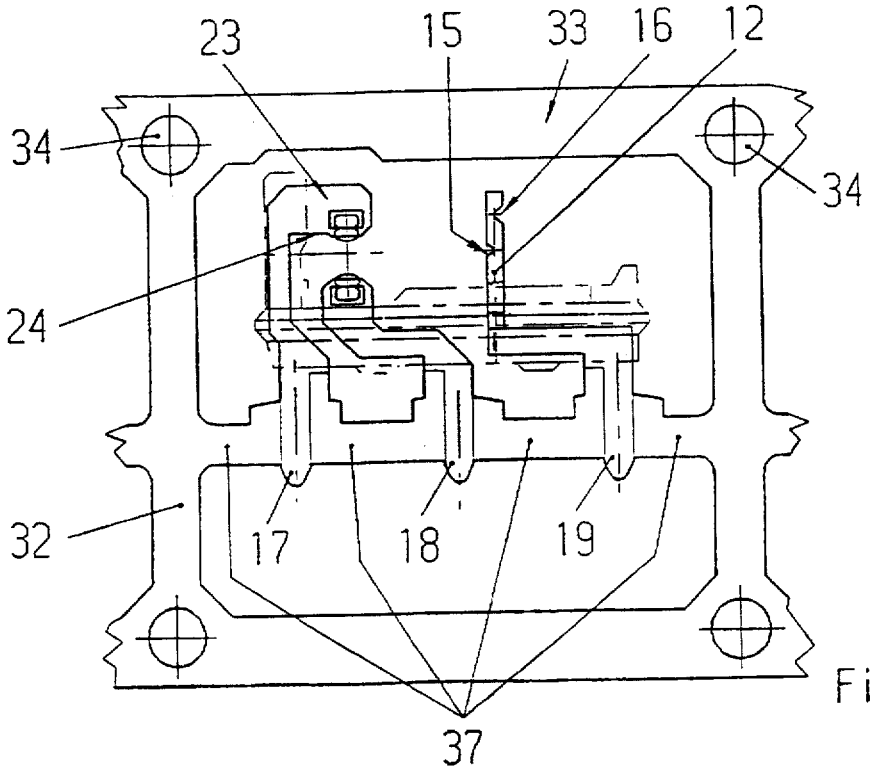
FIG. 6 shows the stamped grid in a further processed form.

The strip 33, with the stamped grids 32 after completion of the recesses 25, as well as a prefabricated wire 35, made of the contact material in the form of a bimetallic wire which can already be profiled in accordance with FIG. 7 to correspond to the recess 25, are fed to a device, which is not shown in more detail and is known per se, in order to produce the stationary contacts 5, 6. Contact pieces made of the wire 35 are cut to the desired length in the device and are subsequently arranged on the contact support 8, 9 in the stamped grid 32 in that the contact piece is inserted from the first side 23 into the recess 25 with its front surface thus approximately vertical with respect to the first side 23, in such a manner that the contact surface 10 of the contact piece is exposed in the opening 26 on the second side 24 of the contact support 8, 9. If desired, the contact surface 10 can also be arranged to project somewhat. After this, the respective contact piece can be still further fastened in the recess 25 of the contact support 8, 9, if this is necessary. A stamped grid 32 is thus obtained, which is arranged in the strip 33 and has stationary contacts 5, 6 as shown in FIG. 6. As already mentioned, the fastening of the contact piece on the contact support 8, 9 can be carried out by stamping, peening and/or welding, preferably spot welding, by means of laser welding, electron-beam welding, resistance welding or the like. However, it must be stressed that there is no further processing of the exposed contact surface 10 of the contact piece, this contact surface 10 rather remaining in the state which already existed on the prefabricated wire 35. The peening, stamping, welding or the like can be carried out, in particular, at right angles to the surface of the strip 33, that is to say from the top and/or from the bottom with respect to the plane of the drawing in FIG. 6, so that damage to the contact surface 10 can be precluded.

Figure 10C:
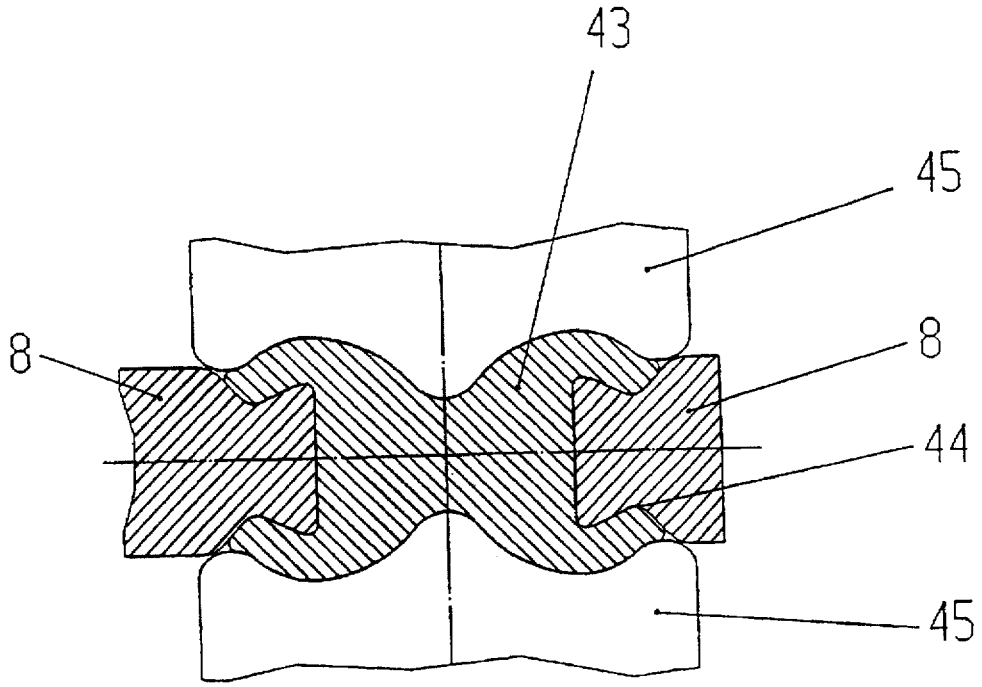
FIGS. 10*a* to 10*c* show the process steps for peening the stationary contact along a line 10—10 in FIG. 9.
Figure 9:
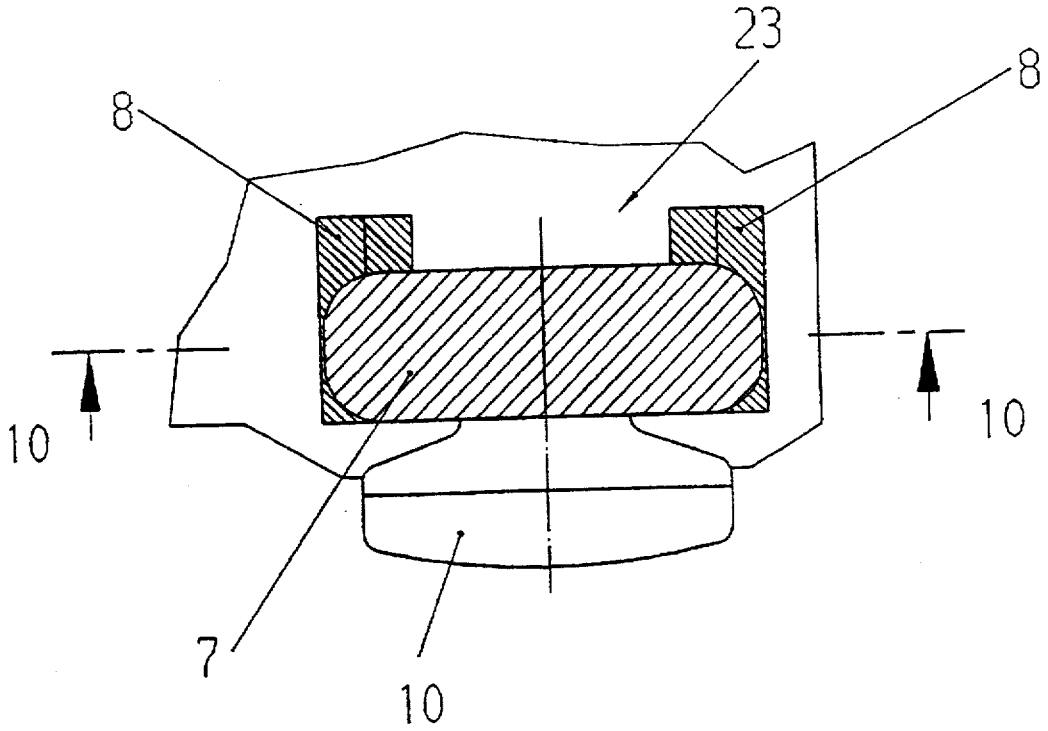
FIG. 9 shows the stationary contact with the contact support corresponding to a detail from FIG. 1 of peened design.
Figure 10A:
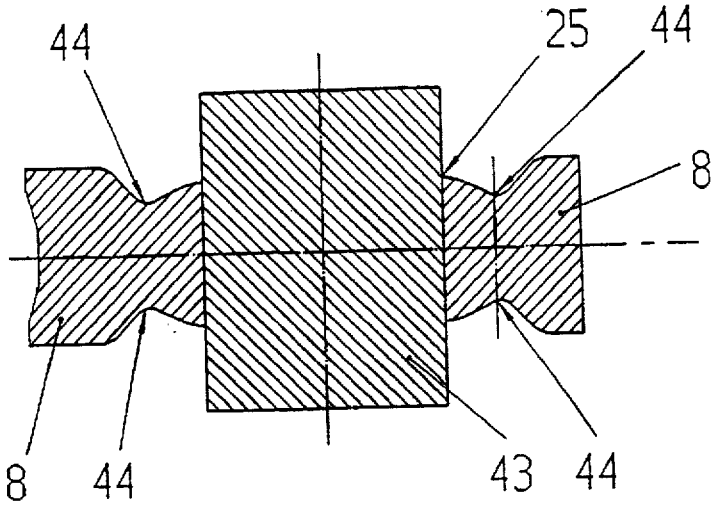
Figure 10B:
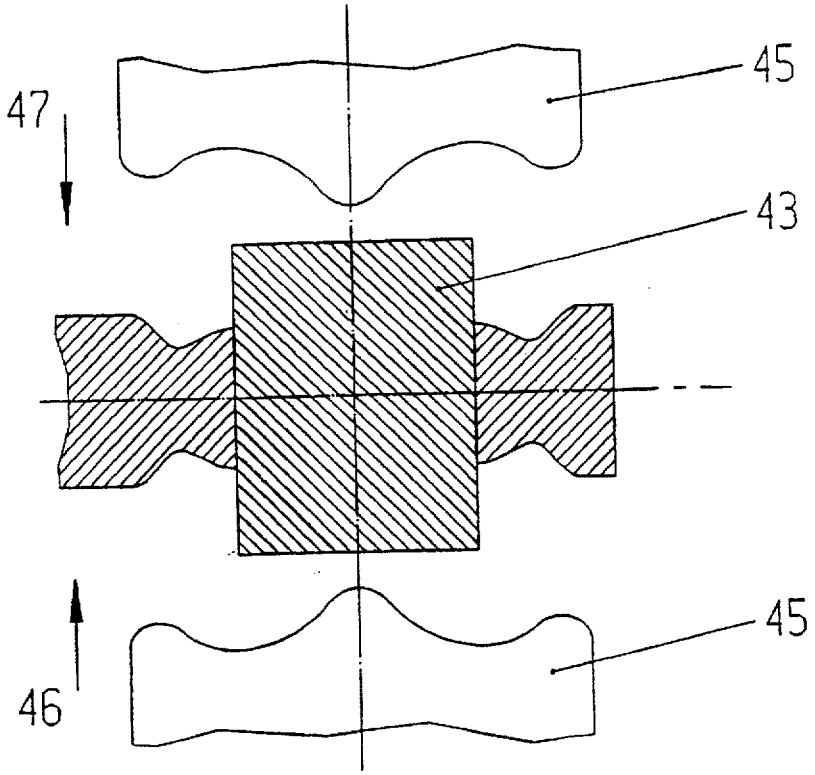

A contact piece which is peened to the contact support is shown byway of example in FIG. 9. As can be seen, the body 7 overlaps the contact support 8 in the edge regions, which are depressed in the first side 23, for fastening. The individual process steps for peening or stamping are shown in more detail in FIGS. 10*a* to 10*c*. As can be seen from FIG. 10*a*, the contact piece 43 which is inserted into the recess 25 on the contact support 8 has a length which projects beyond the recess 25 on the first side 23. In a further embodiment, a contour 44 in the form of a trough is incorporated as a depression in the contact support 8, a force acting in the direction of the contact piece 43 even while this contour 44 is being introduced on the first side 23, so that the contact piece 43 is held in the recess 25 in a clamping manner. In the next process step according to FIG. 10*b*, a tool 45, which is likewise contoured, now acts on the body 7 of the contact piece 43 in the direction of the arrows 46, 47, that is to say in the vertical direction with respect to the first side 23, for peening onto the projecting contact piece 43. In this case, the projecting part of the contact piece 43 is plastically deformed in such a manner that the contact piece 43 is fitted into the contour 44, which is in the form of a trough, as is shown in more detail in FIG. 10*c*. The tool 45 can, of course, also be designed such that the opened body 7 of the contact piece 43 does not have the corrugated surface shown in FIG. 10*c*, but a surface which is essentially level with the first side 23. In order to prevent bending of the recess 25 while these process steps are being carried out, the body 7 can be dimensioned such that an intermediate space 49 remains between the body 7 and that region of the contact support 8 on which the base limb 28 is otherwise located, as can be seen in more detail in FIG. 11. Excess material from the body 7 is accommodated in this intermediate space 49 during peening, thus precluding any adverse effect on the contact support 8, 9.

Figure 11:
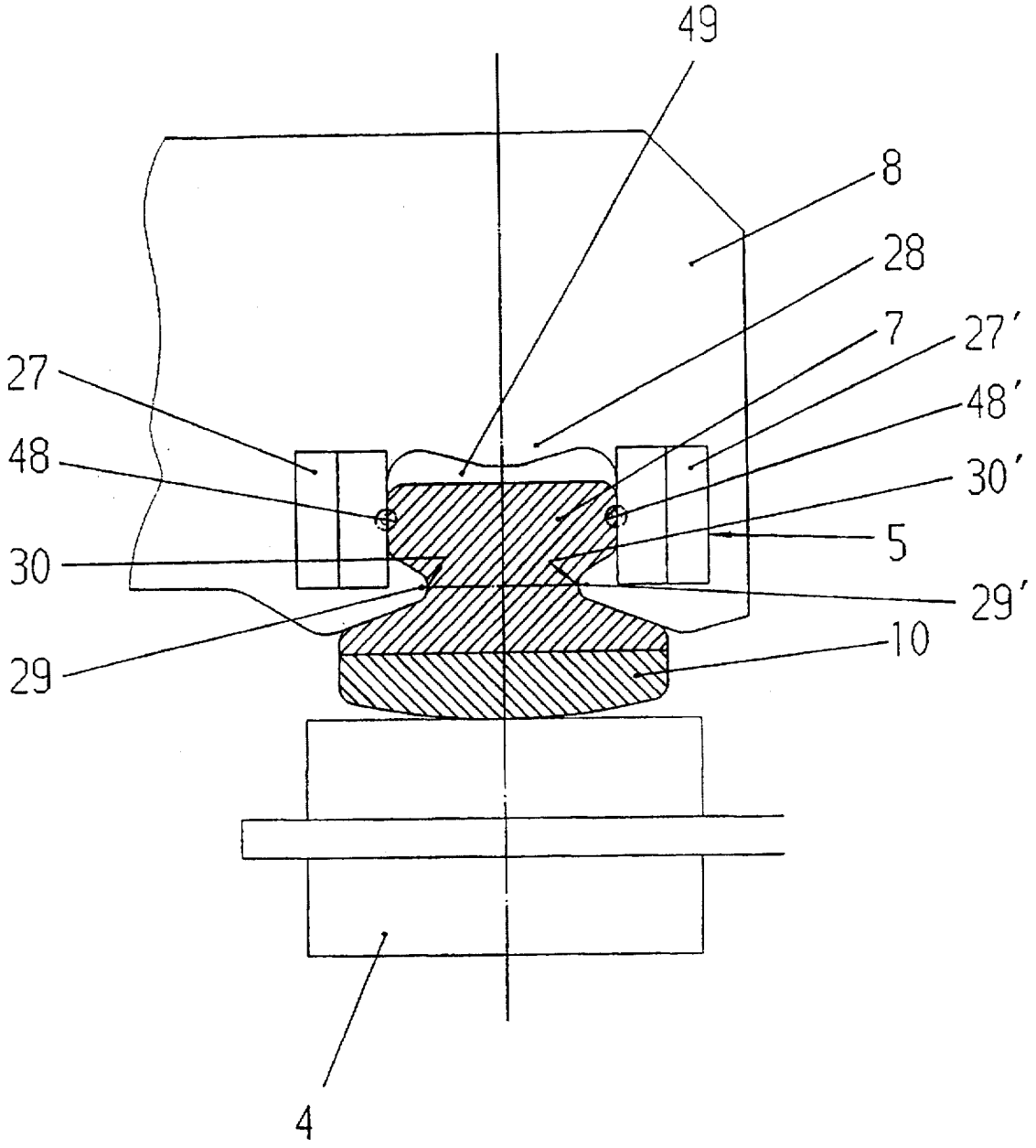
FIG. 11 shows the stationary contact on the contact support in a welded design and FIG. 12 shows an electrical switch having variable electrical connections.

As can furthermore be seen from FIG. 11, particularly in the case of laser welding, it is possible to apply individual spot welds 48, 48' at the transition point between the side limbs 27, 27' on the contact support 8 and the body 7. It is advantageous during laser welding that the spot welds 48, 48' can be positioned very exactly and without adversely affecting the contact surface 10. If the weld is intended to be produced by resistance welding, then the electrodes are for this purpose applied such that the welding current flows from the body 7 to the side limbs 27, 27', so that the spot welds 48, 48' are produced at the desired points.

Once the stationary contacts 5, 6 have been incorporated in the stamped grid 32, the web 12, which lies in a plane with the contact supports 8, 9 in FIG. 5 corresponding to the stamping process, is bent around through approximately 90° at right angles to the plane of the contact supports 8, 9. The web 12 is then in the position shown in FIG. 6, which position is necessary for mounting of the inner lever 13 and of the contact tongue 11 in the correct position with respect to the stationary contacts 5, 6. After this, the stamped grids 32 can be extrusion coated with part of the housing 2, the base 20 in the present example, in an injection molding machine. The bases 20 with the stamped grids 32 are subsequently separated in the strip 33, the connections 37, which are then no longer required and are used only for mechanical cohesion, being cut through at the connections 17, 18, 19 in the stamped grid 32. The base 20 can subsequently be inserted into the housing 2 with the remaining parts of the contact system 3, such as the contact tongue 11, the inner lever 13 etc., in an automatic assembly machine, by means of which the electrical switch 1 is completed.

Figure 12:
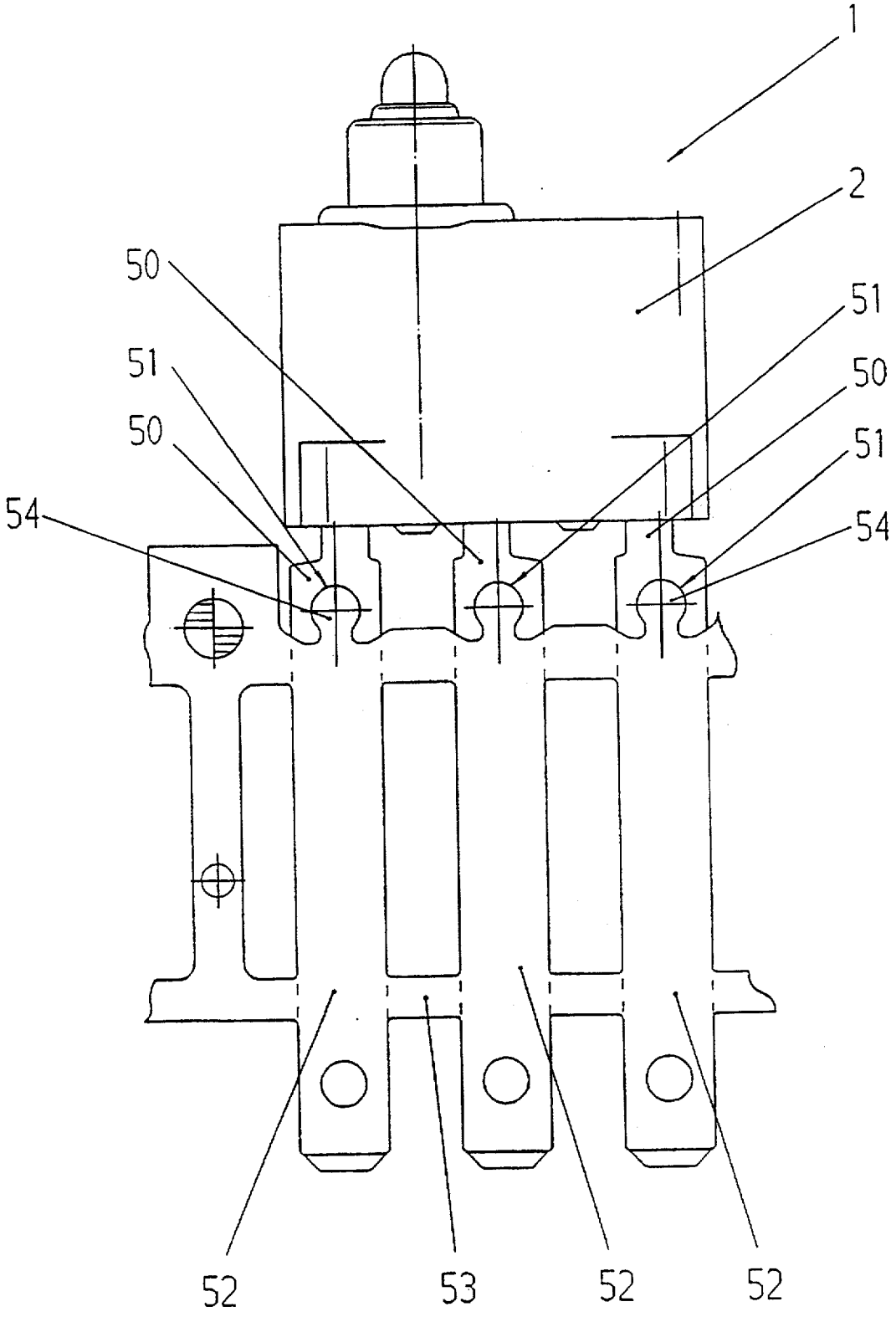

FIG. 12 shows, in a further embodiment, how a completed electrical switch 1 can be equipped in a simple manner with electrical connections which are configured in accordance with the geometry of the electrical connection of the switch to further electrical components. To this end, the connections which project out of the housing 2 of the switch 1 are designed as attachment pieces 50, each having a holder 51. The holder 51 has an approximately circular shape. The connections, which are configured as desired, are produced as connecting tabs 52, for example in the form of a stamped grid 53. Head parts 54 which, in turn, are designed to correspond to the holders 51, are fitted on the connecting tabs 52. The head parts 54 can be inserted into the holders 51 in a positively locking and/or force-fitting manner and can possibly also be welded there. In consequence, a basic model of the switch 1, having any desired connections, can be produced in a flexible manner.

The invention is not limited to the exemplary embodiments described and illustrated. On the contrary, it also comprises all the specialist developments in the context of the essence of the invention. The invention can thus be used not only on switches having small installation spaces, but can also be used advantageously in relatively large switches, for largely automated production.

We claim:

1. A contact system of an electrical switch, the contact system including a movable switching contact having a contact face, and being electrically connectable to a power source, and further comprising:

at least one contact support having a portion defined by a broad side approximately perpendicular to the contact face of the switching contact, and a narrow end face facing the contact face of the switching contact, said contact support having a recess formed in the broad side and extending from a recess opening located in said end face; the recess being defined by a perimeter composed of a side limb extending essentially perpendicularly to said end face, and a base limb located opposite to the recess opening and being connected to the side limb to form an L-shape, and a prefabricated stationary contact arranged on said contact support, and comprised of a bimetallic material, said stationary contact having:

a body composed of a first material, and being received in the recess; said body being electrically connected with at least one of the side limb and the base limb; and a contact surface forming a facing of said body, and being composed of a second material, said contact surface projecting through the recess opening on the end face and interacting with the switching contact to form an electrical connection; said contact surface being located in a plane defined by said end face.

2. The contact system defined in claim 1, wherein said stationary contact further includes a contact coating covering said contact surface.

3. The contact system defined in claim 2, wherein said contact coating is composed of one of gold and gold-silver alloy.

4. The contact system defined in claim 1, wherein said body is composed of one of copper and copper-nickel alloy, and said contact surface is composed of one of silver, silver-nickel alloy, and palladium-copper alloy.

5. The contact system defined in claim 1, wherein said stationary contact comprises a section of a profiled wire, with a front surface of the wire forming said contact surface.

6. The contact system defined in claim 1, wherein said body has a cross-section corresponding to a profile of the recess.

7. The contact system defined in claim 1, wherein said contact surface is located in a plane defined by said end face.

8. The contact system defined in claim 1, wherein said end face includes a projection that projects in a direction of the switching contact for fastening of said body in the recess.

9. The contact system defined in claim 1, wherein said body is fastened in the recess using one of stamping, peening, laser welding, electron-beam welding and resistance welding.

10. The contact system defined in claim 1, wherein said contact support is formed from a stamped grid.

11. The contact system defined in claim 1, wherein the perimeter of the recess is composed of a further side limb connected to the base limb to form a U-shape.

12. The contact system defined in claim 1, wherein at least one of the limbs is depressed relative to a surface of said broad side for accommodating displaced material from said body.

13. The contact system defined in claim 1, wherein said body has an indentation in a side thereof; further comprising an attachment projecting from a respective side limb approximately perpendicularly thereto and approximately parallel to the base limb, and engaging with the indentation of said body.

14. An electrical switch, comprising:

a housing; and a contact system located within said housing, and including:

a movable switching contact having a contact face, and being electrically connectable to a power source;

at least one contact support having a portion defined by a broad side approximately perpendicular to the contact face of said switching contact, and a narrow end face facing the contact face of said switching contact, said contact support having a recess formed in the broad side and extending from a recess opening located in said end face; and a prefabricated stationary contact connected to said contact support, and comprised of a bimetallic material, said stationary contact having:

a body composed of a first material, and being insertable into the recess;

a contact surface forming a facing of said body, and being composed of a second material, said contact surface projecting through the recess opening on said end face and interacting with said switching contact to form an electrical connection;

an operating device projecting out of an upper region of said housing, and having a portion extending into an interior of said housing;

a plate fastened to an inside base of said housing and projecting toward the upper region of said housing, said plate having a first holder, and a second holder located closer to said operating device that the first holder;

a contact tongue having a first end movably mounted in the first holder, and a second end having said switching contact mounted thereto;

a tension spring having two ends, one end being connected to said contact tongue; and a two arm lever having a first pivot arm, a second pivot arm, and an intermediate region pivotally mounted in the second holder, said first pivot arm being on one side of said plate and being operatively connected to the portion of said operating device, and said second pivot arm being on the other side of said plate, and being connected to the other end of said tension spring.

15. The electrical switch defined in claim 14, wherein the portion of said operating device extending into the interior of said housing includes two oppositely arranged guide ribs, each projecting toward the inside base of said housing on a respective side of said first pivot arm, said housing having two oppositely located side walls, each having a housing guide engaging with a respective guide rib.

16. The electrical switch defined in claim 14, further comprising a housing base removable from said housing, and having a circumferential ridge; wherein said housing includes a circumferential recess engageable with the circumferential ridge.

17. An electrical switch, comprising:

a housing; and a contact system located within said housing, and including:

a movable switching contact having a contact face, and being electrically connectable to a power source;

at least one contact support having a portion defined by a broad side approximately perpendicular to the contact face of said switching contact, and a narrow end face facing the contact face of said switching contact, said contact support having a recess formed in the broad side and extending from a recess opening located in said end face; and a prefabricated stationary contact connected to said contact support, and comprised of a bimetallic material, said stationary contact having:

a body composed of a first material, and being insertable into the recess;

a contact surface forming a facing of said body, and being composed of a second material, said contact surface projecting through the recess opening on said end face and interacting with said switching contact to form an electrical connection;

an electrical connection electrically connected with said contact support, projecting out of said housing, and including a holder located on the outside of said housing;

and a connecting tab attachable to said holder in a positive locking manner and being connectable to further electrical components.

* * * * *